United States Patent [19]

McIntyre

[11] Patent Number: 4,753,341

[45] Date of Patent: Jun. 28, 1988

[54] COUNTER DISPLAY RACK WITH MULTIPLY THICKNESS WALLS AND POCKETS

[75] Inventor: Ross McIntyre, Salt Lake City, Utah

[73] Assignee: Packaging Corporation of America, Evanston, Ill.

[21] Appl. No.: 11,906

[22] Filed: Feb. 6, 1987

[51] Int. Cl.[4] ..... B65D 5/48

[52] U.S. Cl. ..... 206/45; 206/45.19; 211/72; 211/133; 229/120.38; 229/164; 248/174

[58] Field of Search ..... 206/45, 45.13, 45.19, 206/45.11, 44 R, 45.14; 229/164, 23 R, 16 D, 27, 28 R, 120.25, 120.34, 120.36, 120.38; 211/72, 133; 248/174

[56] References Cited

U.S. PATENT DOCUMENTS

| | | | |
|---|---|---|---|
| 1,289,518 | 12/1918 | Myers | 206/45.19 |
| 1,881,986 | 10/1932 | Webster | 248/174 |
| 2,006,822 | 7/1935 | Andrews | 229/120.38 |
| 2,135,533 | 11/1938 | Ringler | 206/45 |
| 2,430,166 | 11/1947 | Fish et al. | 206/45 |
| 2,564,672 | 8/1951 | Burr | 206/45 |
| 2,801,754 | 8/1957 | Dorfman | 248/174 |
| 2,914,184 | 11/1959 | Dgetluck | 206/45 |
| 3,037,618 | 6/1962 | Holes et al. | 206/45 |
| 3,227,266 | 1/1966 | Soma | 229/16 D |
| 3,999,662 | 12/1976 | Barnherdt | 229/28 R X |
| 4,053,101 | 10/1977 | Hart, Jr. | 206/45.13 |

*Primary Examiner*—Stephen Marcus
*Assistant Examiner*—Bryon Gehman
*Attorney, Agent, or Firm*—Neuman, Williams, Anderson & Olson

[57] ABSTRACT

A counter display rack is provided which is formed from a primary blank and a secondary blank, both blanks being a foldable sheet material. The display rack includes a plurality of open top pockets arranged in at least one row extending from a front wall to a rear wall of the display rack. Each pocket has a recessed bottom section and upright front, rear and side sections. The bottom section of the rearmost pocket having a greater elevation than the bottom section of the front pocket of the row. The primary blank, when setup, defines exterior front, rear and side walls of the display rack and the front, rear, side and bottom sections of at least the rearmost pocket of the row. When setup, the secondary blank defines at least the front and rear sections of a pocket disposed forwardly of the rearmost pocket.

15 Claims, 4 Drawing Sheets

COUNTER DISPLAY RACK WITH MULTIPLY THICKNESS WALLS AND POCKETS

BACKGROUND OF THE INVENTION

Various types of counter display racks, sometimes hereinafter refused to as displays formed of foldable sheet material (e.g. doubled faced corrugated fiberboard) have heretofore been utilized. Where such prior displays incorporated a plurality of pockets for accommodating booklets, pamphlets and the like, such displays were beset with one or more of the following shortcomings: (a) they were of complex and costly design; (b) required an inordinate amount of materials (c) were difficult and awkward to setup; (d) were unattractive in appearance; (e) were unstable and incapable of accommodating a variety of products; (f) were incapable of being shipped or stored in a collapsed state; (g) required adhesives, staples or the like to retain the blanks in a setup state; and (h) were not adapted to being selectively supported on either a vertical wall or a horizontal counter.

SUMMARY OF THE INVENTION

Thus, it is an object of the invention to provide a counter display which avoids all of the aforenoted shortcomings.

It is a further object to provide a counter display which is of simple, inexpensive and lightweight construction.

It is a further object to provide a counter display which is stable whether wall or counter supported, and is capable of accommodating simultaneously a variety of products with the products being arranged in segregated groups.

It is a still further object to provide a counter display for accommodating a plurality of products arranged in segregated groups, whereby a product from one group may be manually removed without disturbing the products in the other segregated groups.

Further and additional objects will appear from the description, accompanying drawings and appended claims.

In accordance with one embodiment of the invention, an improved counter display rack is provided which is formed from a primary blank and a secondary blank. The blanks, when setup, coact to form a plurality of open top pockets arranged in at least one row and extending from the exterior front wall of the display to the exterior rear wall thereof. Each pocket includes a bottom section and upright front, rear and side sections. The setup primary blank defines the exterior front, rear and side walls and the bottom wall, and the front, rear and bottom sections of at least the rearmost pocket of the row. The bottom section of the rearmost pocket is at a greater elevation than the bottom section of the front pocket of the row. The setup secondary blank defines the front, rear and bottom sections of a pocket disposed forwardly of the rearmost pocket.

DESCRIPTION

For a more complete understanding of the invention reference is made to the drawings wherein FIG. 1 is a front perspective view on a reduced scale of a preferred embodiment of the improved counter display.

Figure 1:
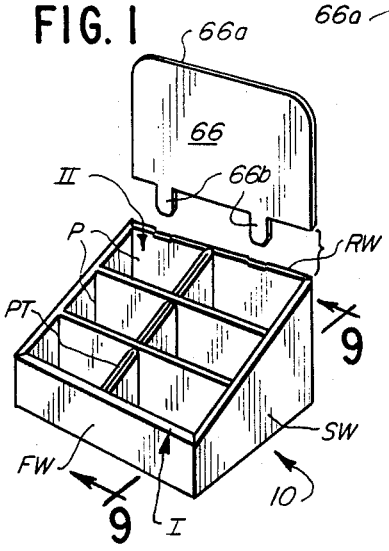

Referring now to the drawings and more particularly to FIG. 1 a preferred embodiment of the improved counter display 10 is shown which is suitable for accommodating a plurality of booklets, pamphlets or the like segregated into a predetermined number of groups, not shown. Each group is accommodated within a designated pocket P provided in the counter display. The use herein of the term -counter display- is intended to refer to a display which is either wall or counter supported.

Display 10 is formed from a pair of complemental blanks 11, 12 preferably of doubled faced corrugated fiberboard material. Blank 11 is hereinafter referred to as the primary blank and blank 12 is hereinafter referred to as the secondary blank.

In the illustrated display 10 the pockets P thereof are arranged in two rows I, II of three pockets each. The rows extend from an exterior front wall FW to an exterior rear wall RW of the display and are separated from one another by an upright partition PT. The front and rear walls FW, RW are interconnected by side walls SW arranged in substantially parallel relation. The front, rear and side walls extend upwardly from the periphery of a bottom wall BW, see FIGS. 8 and 9.

Figure 9:
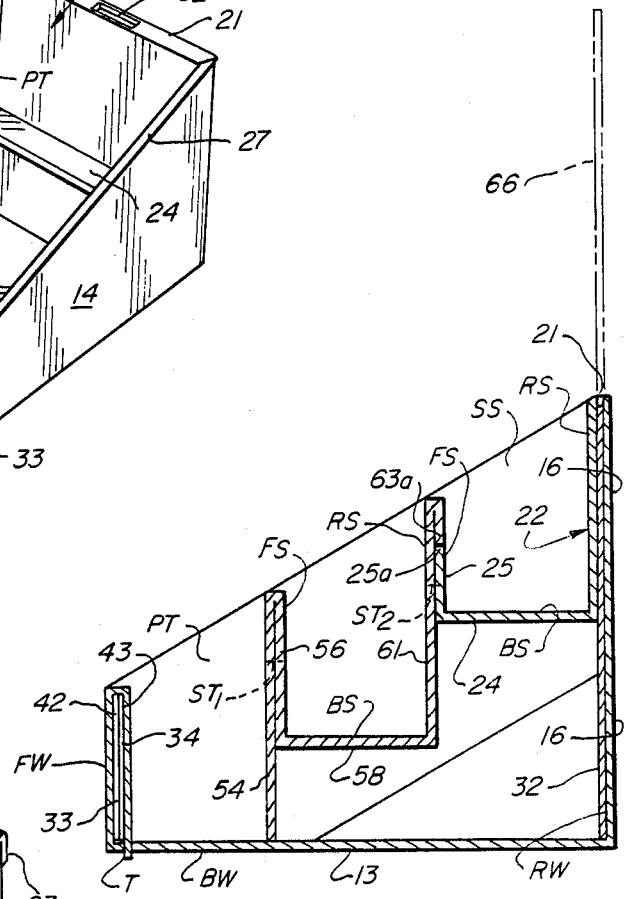
FIG. 9 is an enlarged sectional view taken along line 9—9 of FIG. 1.

Each pocket P includes a front section FS, a rear section RS, a bottom section BS and side sections SS, see FIG. 9. Each section as illustrated, except for the bottom section BS, is of multi-ply thickness, that is to say it comprises two or more panels arranged in face to face relation, as will be described more fully hereinafter.

Figure 2:
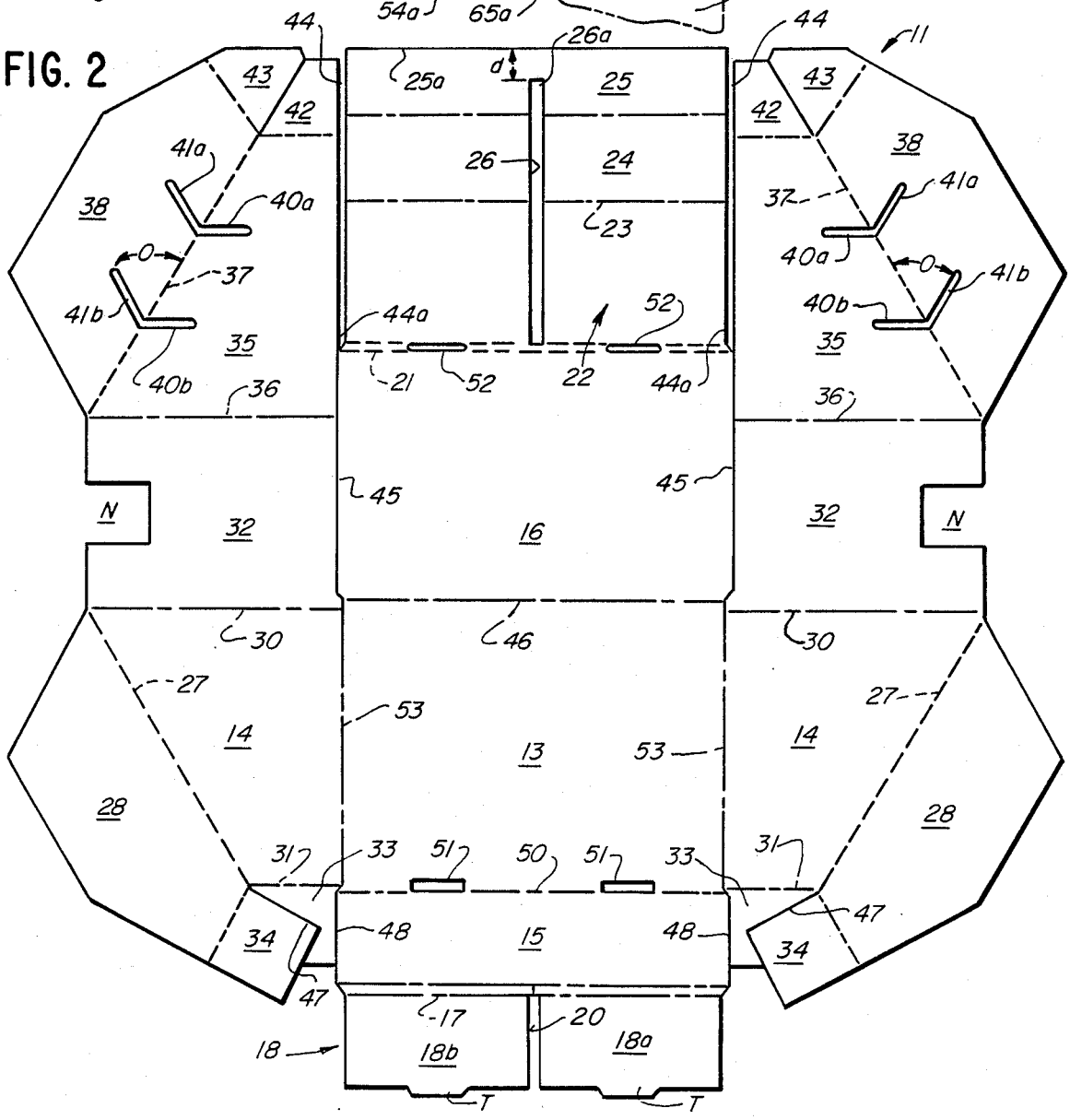
FIG. 2 is an enlarged plan view of the primary blank for the display of FIG. 1.

Blank 11, as seen in FIG. 2, includes a bottom wall-forming multilateral (e.g. rectangular) panel 13 having a pair of outer side wall-forming panels 14 foldably connected to opposite first peripheral segments of the panel 13. Foldably connected to opposite second peripheral segments of panel 13 are an outer front wall-forming panel 15 and an outer rear wall-forming panel 16. Connected by a double foldline 17 to the outer edge of front wall-forming panel 15 is an inner front wall-forming panel 18. Panel 18 is separated into two sections **18*a*, 18*b* by a slot 20 which extends transversely outwardly from foldline 17 and terminates at the outer, or distal, edge of the panel 18. While the panel sections 18*a*, 18*b*** are of like configuration the invention is not intended to be limited thereto.

Connected by a double foldline 21 to the outer edge of outer rear wall-forming panel 16 is an inner rear wall-forming panel 22. In addition to serving as a component of the exterior rear wall RW of the display 10, panel 22 also functions as the rear section RS of the rearmost pocket, when blank 11 is setup, see FIG. 9.

Connected by foldline 23 to the outer edge of panel 22 is a bottom section-forming panel 24. Foldably connected to the side of panel 24 opposite panel 22 is a front section-forming panel 25. Panels 22, 24, and 25 are provided with an elongated common slot 26, which extends transversely outwardly from double foldline 21 and terminates within panel 25, see FIG. 2. Slots 20 and 26 are disposed in spaced endwise alignment. The function of such slots will be described more fully hereinafter.

Connected by foldlines 27 to the outer edges of outer side wall-forming panels 14 are inner side wall-forming panels 28. Each foldline 27 extends from a rear corner-forming foldline 30 to a front corner-forming foldline 31. Each foldline 30 connects rear wall-forming panel 32 to the corresponding outer side wall-forming panel 14. Each foldline 31 connects a first tuck flap 33 to the corresponding panel 14. A second pair of tuck flaps 34 are foldably connected to the corresponding front edges of the inner side wall-forming panels 28. When primary blank 11 is setup, tuck flaps 34 along with tuck flaps 33 are sandwiched between the outer and inner front wall-forming panels 15, 18, see FIG. 6 and 7. Panels 28 and associated tuck flaps 34 are optional and may be eliminated, if desired. When, however, these panels and flaps are eliminated a raw (cut) edge of each panel 14 would be exposed which in certain environments, wherein the display is placed, might be unattractive and thus, undesirable.

Referring again to FIG. 2, blank 11 is provided with a first pair of partition-forming panels 35 which are connected by foldlines 36 to the corresponding rear wall-forming panels 32. As noted, panels 14 and 35 have a similar configuration. Connected by foldlines 37 to the outer edges of panels 35 is a second pair of partition-forming panels 38. Partition-forming panels 35 and 38 are sometimes referred to hereinafter as foldably connected sections. As noted in FIG. 2, panels 38 and panels 28, the latter foldably connected to panels 14, are of similar configuration. Each panel 35 is provided with a pair of slots **40*a*, 40*b*, each of which extends a short distance from foldline 37. The slots 40*a*, 40*b* are parallel to each other and to foldline 36. The spacing between slots 40*a*, 40*b* and the spacing of each slot from the foldline 36** determine the front to rear dimensions of the pockets in a row.

Figure 6:
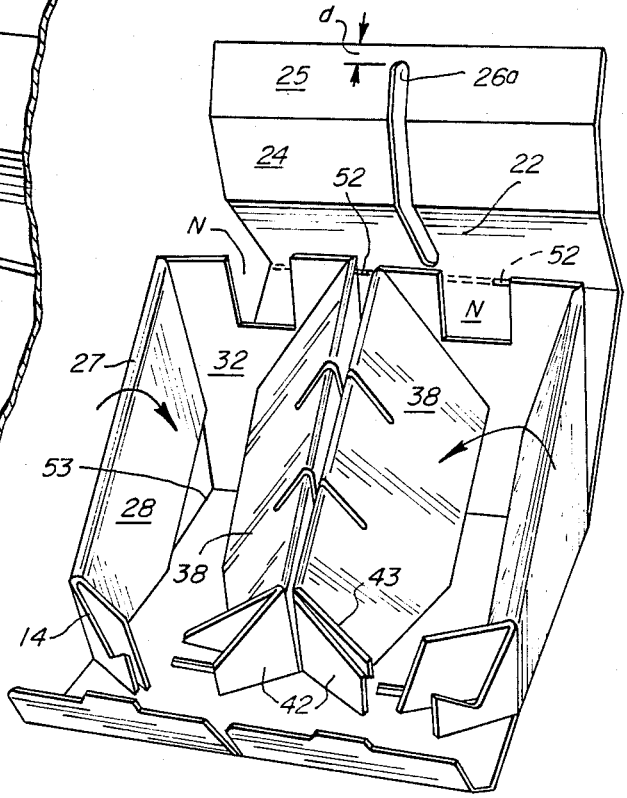
Figure 7:
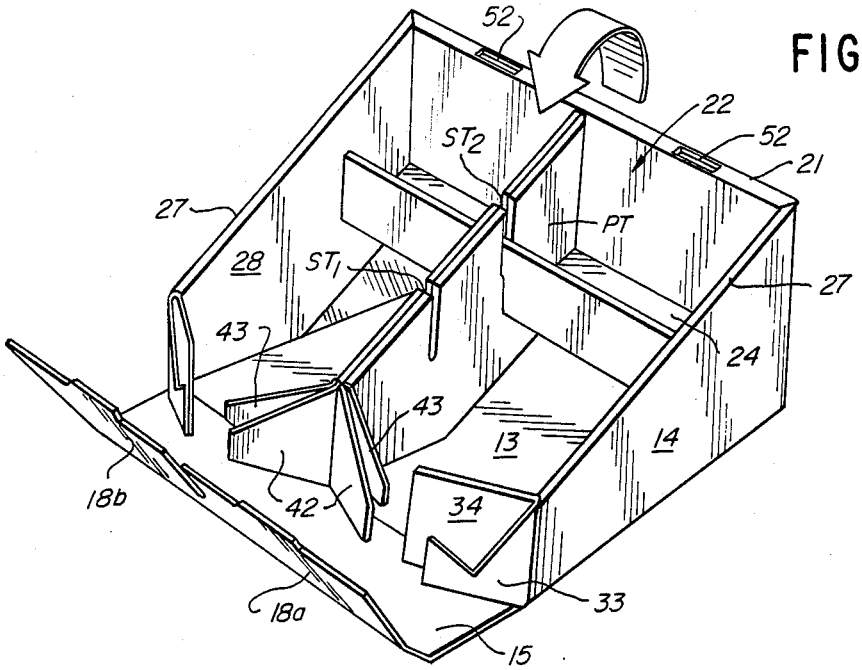

Each partition-forming panel 38 is also provided with a pair of slots **41*a*, 41*b*, each of which extends at a predetermined angle $\theta$ (e.g. approximately 60° ) from foldline 37. The open ends of corresponding slots 40*a*, 41*a* and 40*b*, 41*b* are aligned with one another. When blank 11 is setup, corresponding panels 35, 38 are disposed in face to face relation and the slots 40*a*, 41*a* and 40*b*, 41*b* are in aligned, substantially coextensive relation, see FIG. 8. The number of slots formed in panels 35 and 38 will depend upon the number of pockets P comprising a row I, II. The upper edges of panels 35, 38, as viewed in FIG. 2, have foldably connected thereto third and fourth tuck flaps 42, 43, respectively. When blank 11 is setup, tuck flaps 42, 43 as seen in FIGS. 6, 7 are sandwiched between front wall-forming panels 15, 18 as will be described more fully hereinafter. As in the case of panels 28 and tuck flaps 34, panels 38 and associated tuck flaps 43** are optional and may be eliminated if desired.

Panels 35 and associated tuck flaps 42 are disposed on opposite sides of panels 22, 24 and 25 and are separated therefrom by elongated, substantially parallel slots 44, see FIG. 2. The lower ends **44*a* of the slots terminate at aligned cuts 45. The cuts 45 extend to the opposite ends of a foldline 46 which interconnects panels 13, 16 and thus, separate panel 16 from panels 32 and portions of panels 35**.

It will be noted in FIG. 2, that each pair of tuck flaps 33, 34 is separated from one another by a cut 47, and that flaps 33 are separated from the adjacent end portions of panel 15 by cuts 48. Foldline 50, which interconnects panels 13 and 15, is interrupted by a pair of longitudinally spaced slots 51. The slots 51 extend into panel 13. Slots 51 are adapted when the blank is setup, to interlockingly accommodate tabs T formed on the lower edges of panel sections **18*a*, 18*b***.

Double foldline 21, which interconnects panels 16 and 22, may also be interrupted by a pair of longitudinally spaced slots 52. The function of slots 52 will become apparent from the description to follow. Panels 32 have the exposed edges thereof provided with notches N which become aligned with corresponding slots 52 when the primary blank 11 is setup, see FIGS. 6 and 7.

Figure 4:
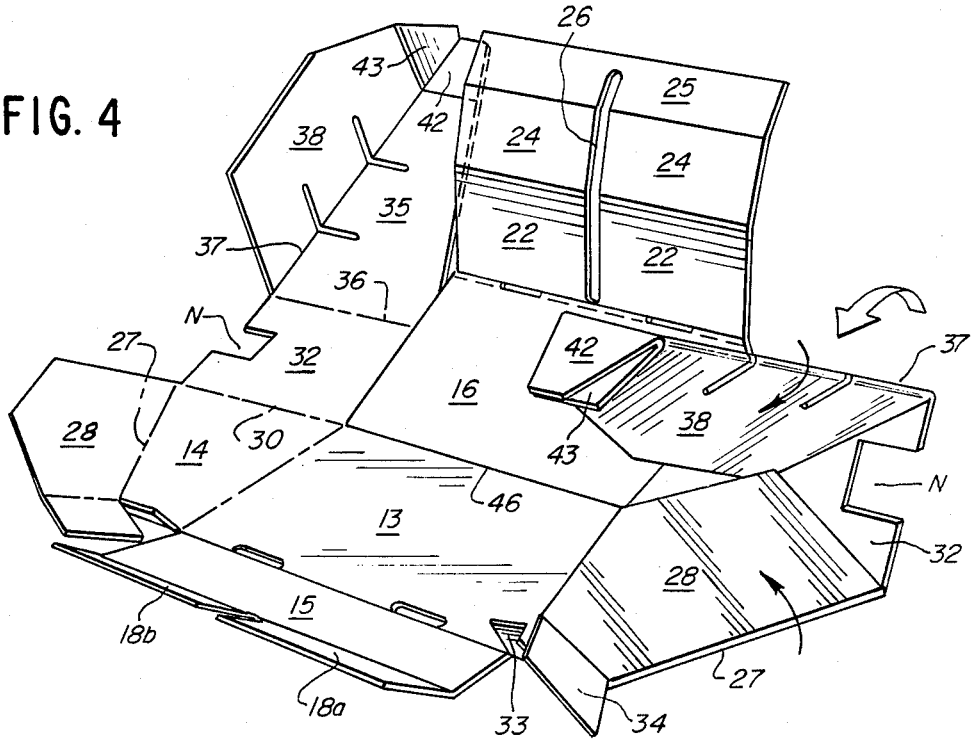
FIGS. 4–7 are perspective views of the primary blank of FIG. 2 in successive stages of setup.
Figure 5:
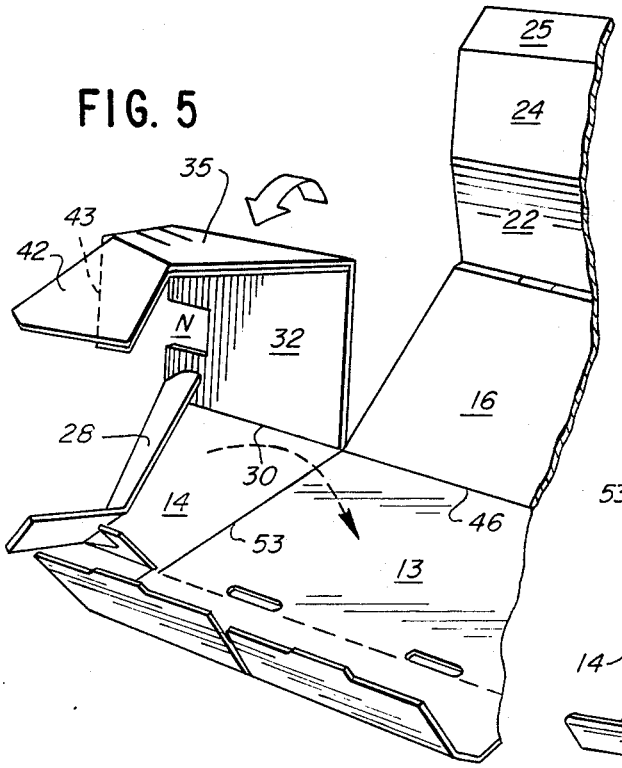

Referring to FIGS. 4–7 the successive steps for setting up the primary blank are shown. The initial setting up step is shown in FIG. 4 and involves the inner side wall-forming panels 28 being folded into overlying relation with the corresponding outer side wall-forming panels 14. Each partition-forming panel 38 is then folded about foldline 37 so as to overlie the corresponding other partition-forming panel 35. The panels 35, 38 are then folded as a unit about foldline 36 to a substantially upright position relative to the corresponding intermediate rear wall-forming panel 32. Panel 32 and the prefolded panels 35, 38 are then folded as a unit about foldline 30, see FIG. 5, until panel 32 is substantially perpendicular to panel 14. While the aforenoted panels are disposed in the latter folded relation, each panel 14 and the associated prefolded panels are folded as a unit about foldline 53, the latter interconnecting panels 13 and 14, until panel 32 assumes an upright substantially perpendicular position with respect to bottom wall panel 13, see FIG. 5 and 6. The relative dimensions of the two panels 32 are such that partition-forming panels 35 will be disposed in face to face relation; thus, a four-ply or four panel thickness partition PT is formed, which extends perpendicularly from the rear wall RW to the front Wall FW, see FIGS. 7 and 8.

Once the partition PT has been formed in the manner, aforedescribed, the panels 16, 22, 24 and 25 are folded as a unit about foldline 46 to an upright position until panels 16 and 32 are in face to face relation. Once panels 16 and 32 assume this relationship, panel 22 is folded over the upper notched edges of panels 32 and then downwardly until panels 22 and 32 are in face to face relation, see FIG. 7. Simultaneously with the folding of panel 22 relative to panels 32, panel 24 is folded perpendicularly to panel 22 so as to assume an elevated substantially parallel relation with respect to bottom wall panel 13, see FIG. 9. As this occurs panel 25 will assume an upright position with respect to panel 24 and a spaced substantially parallel position with respect to panel 22.

Figure 8:
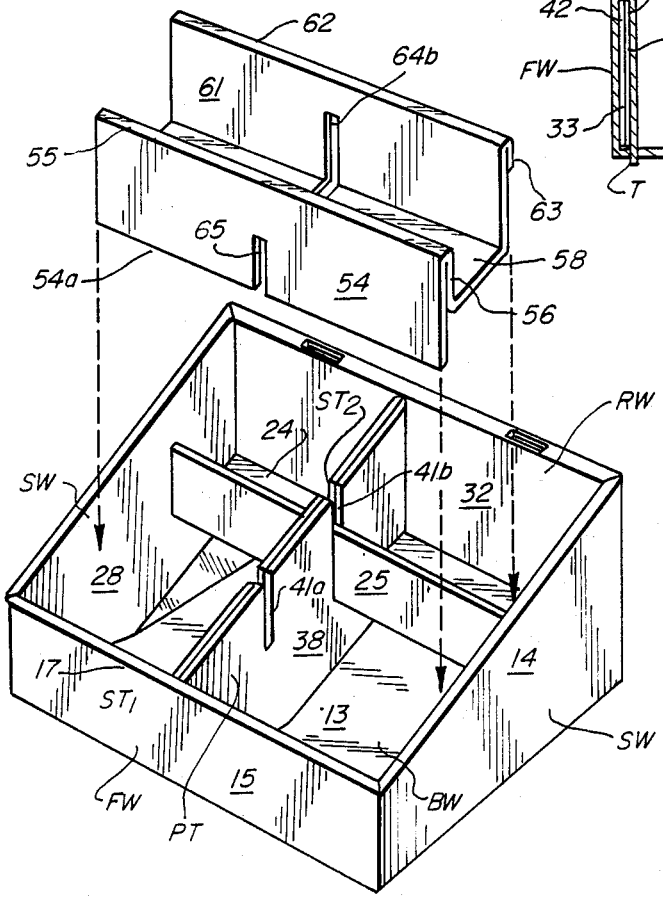
FIG. 8 is a front perspective view of the setup primary and secondary blanks in exploded relation.

It will be noted in FIGS. 7 and 8 that, when the partition-forming panels 35, 38 are disposed in face to face relation and perpendicular to the front and rear walls FW, RW, the slots **40*a*, 41*a* and 40*b*, 41*b* coact to form upwardly extending open ended slots $ST_1$ and $ST_2$. In a similar manner, when panels 22, 24 and 25 are folded relative to one another as afore-described, segments of slot 26 will coact with one another to form a downwardly extending slot, which will allow the panels 22, 24 and 25 to extend laterally outwardly from opposite sides of the partition PT and span the distance between the partition and the sidewalls SW of the display, see FIGS. 7 and 8. The distance d between the end 26***a* of slot 26 and the edge of panel 25, determines the extent to which panel 25 can be pushed down into slot $ST_2$ and thus, assures that panel 24 will be in the proper elevated position as shown in FIG. 9.

Figure 3:
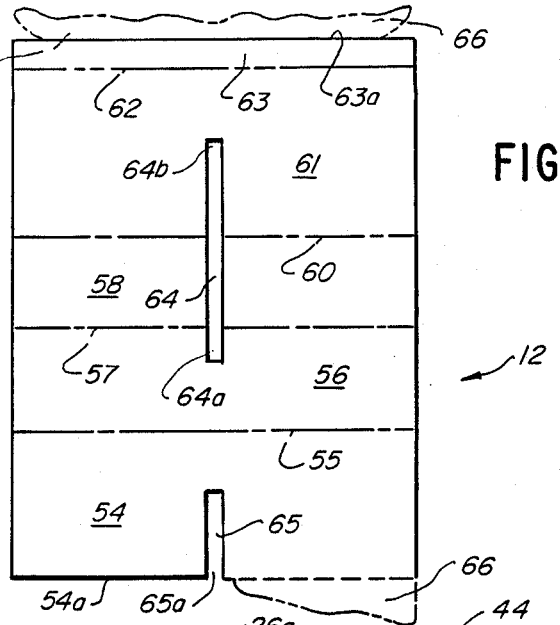
FIG. 3 is an enlarged plan view of the secondary blank for the display of FIG. 1 and showing in phantom lines a portion of a sign board panel connected by a perforated line to the top edge of the secondary blank.

Once primary blank 11 has been setup in the manner afore-described, the secondary blank 12 is then setup in a manner to be hereinafter described. Blank 12, as shown in FIG. 3, has a generally rectangular peripheral configuration and includes a rear section-forming panel 54 which is connected by foldline 55 to a front section-forming panel 56. Connected by foldline 57 to the opposite side of panel 56 is a bottom section-forming panel 58. Foldline 60 interconnects panel 58 to a rear section-forming panel 61 and a foldline 62 connects an elongated flap 63 to the opposite side of panel 61. All of the foldlines 55, 57, 60 and 62 are disposed in substantially parallel relation. An elongated slot 64 is provided in panels 56, 58 and 61. One end 64*a* of the slot terminates in panel 56 and the opposite end 64*b* terminates in panel 61. Slot 64 is centrally disposed and is perpendicular to foldlines 57, 60.

Panel 54 is provided with an elongated slot 65 which has one end 65*a* thereof terminating at the edge of the panel opposite foldline 55. Slots 64 and 65 are in spaced, endwise alignment.

If desired, a sign board panel 66 may be connected by a line of perforations to either the top or bottom edge of the blank 12. The upper edge 66*a* of the sign board panel 66 is preferably the peripheral portion which is initially connected to either panel 54 or flap 63 of the blank 12 see FIG. 3. The sign board panel 66 is optional.

When blank 12 is setup see FIG. 8, panels 54, 56 are disposed in face to face relation; panel 58 extends rearwardly at a right angle; panel 61 extends vertically upwardly from the back edge of panel 58; and flap 63 is folded over and engages the back side of panel 61. Once blank 12 has been setup as aforedescribed, it is pushed downwardly relative to the open top of setup blank 11 so that slot $ST_1$, will interlock with slot 65 and a portion of slot 64 extending into panel 61 will interlock with slot $ST_2$. The downward movement of the setup blank 12 is stopped when the lower edge 54*a* of panel 54 engages the bottom wall panel 13 and the lower edge 63*a* of flap 63 abuts the upwardly facing edge 25*a* of panel 25 of the setup blank 11, see FIG. 9. It should be noted that no adhesive, staples, tape or the like is required to retain the blanks in their assembled setup mode as seen in FIG. 1 and 9.

The optional sign board panel 66 is provided with a pair of laterally spaced tabs 66*b* which are adapted to be inserted through slots 52 formed in foldline 21 and into the aligned notches N formed in the corresponding edges of panels 32 which are sandwiched between panels 16 and 22 in the setup blank 11.

As seen in FIG. 9, the bottom section of the rearmost pocket is elevated a greater distance from the bottom wall panel 13 than the bottom sections of the remaining pockets comprising the row I or II. The bottom section of the middle pocket of the row is at a lesser elevation than that of the rearmost pocket but is at a greater elevation than the bottom section of the front pocket of the row. Setup blank 12 in the illustrated embodiment forms the back, bottom and front sections of the middle pocket and the rear section of the front pocket. It will be noted that a portion of the bottom wall panel 13 functions as the bottom section of the front pocket and the inner front wall-forming panel 18 functions as the front section of the front pocket. By reason of the bottom sections of the pockets in a row having increased elevations starting from the front pocket, the booklets or pamphlets accommodated in the pockets will be more readily observable. Furthermore, by having individual pockets the accommodated booklets, pamphlets or the like can be readily segregated into various groups. Removal of one or more booklets, pamphlets or the like from a selected pocket will not disturb the contents of the other pockets.

Figure 10:
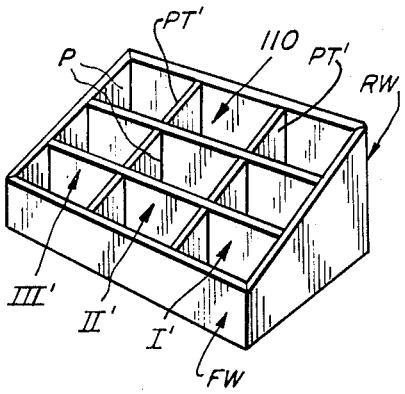
FIG. 10 is similar to FIG. 1 but showing a second embodiment of the improved counter display.
Figure 12:
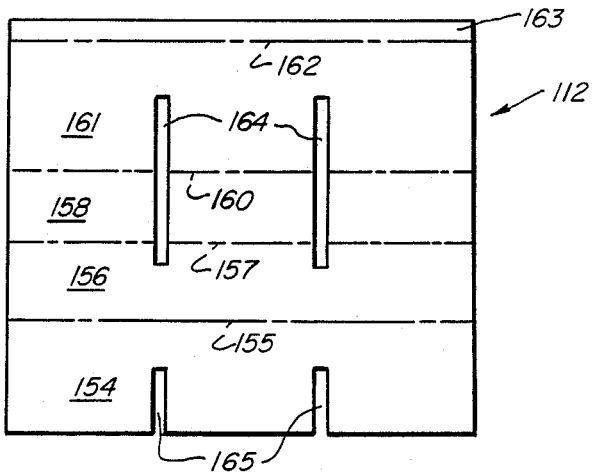
FIG. 12 is similar to FIG. 3 but showing the secondary blank of the display of FIG. 10.

FIG. 10 discloses a second embodiment 110 of the improved counter display. Portions of display 110 which correspond to like portions of display 10 will be identified by like numbers but in the 100 series. Display 110 differs from display 10 primarily in that display 110 embodies three rows I', II' and III' of pockets instead of two. The rows are arranged in side by side, parallel relation and each row extends from the exterior front wall FW to the exterior rear wall RW of the display. The number of pockets forming a row may be a greater or lesser number than shown in FIG. 10.

The primary blank 111 for display 110 has a configuration similar to that shown in FIG. 2, except that the widths of panels 118, 115, 113, 122, 124 and 125 are greater than the widths of the corresponding panels of blank 11 in order to accommodate the additional row III': a further structural difference between blanks 11 and 111 is that the latter is provided with two sets of parallel slots 120 and 126. Slots 120 are disposed in panel 118 and transform the latter in three sections 118 *a–c* which in the illustrated embodiment are of like configuration and define the widths of the pockets P in each row. If desired, the widths of each row of pockets can be dissimilar in which case the location of the slots 120 relative to each other and to the ends of the panel 118 will reflect the same width dissimilarity.

Figure 11:
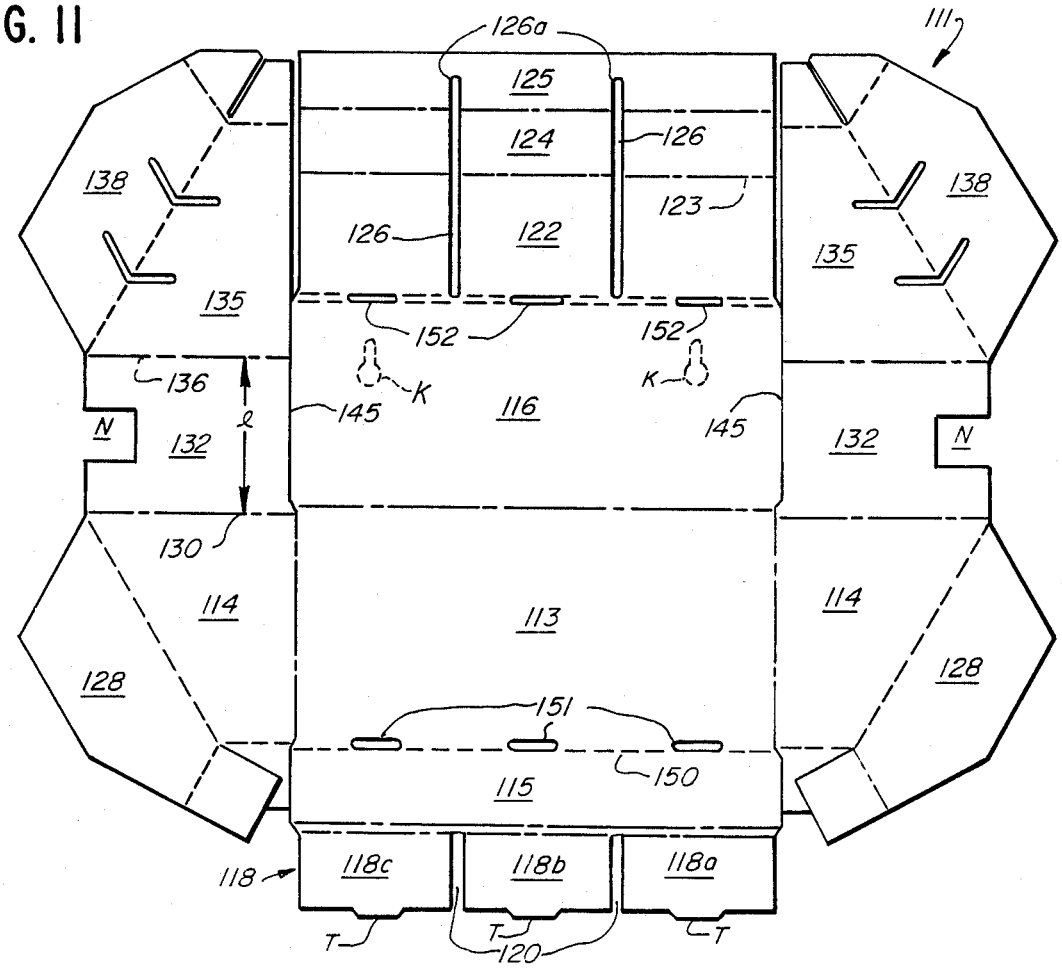
FIG. 11 is similar to FIG. 2 but showing the primary blank of the display of FIG. 10.

As seen in FIG. 11, the lower free edge of each panel section 118 *a–c* is provided with a tab T, which, when the blank is setup, is adapted to interlockingly engage a corresponding slot 151 formed in the foldline 150 connecting panels 113, 115.

The second set of parallel slots 126 is formed in panels 122, 124 and 125 and is in endwise alignment with slots 120. The distance each slot 126 is set in from the corresponding side edges of panels 122, 124 and 125 is equal to dimension e measured between foldlines 130, 136. When blank 111 is setup, panels 132 will be in face to face relation with approximately the side one third of the panel 116, the latter forming the exterior rear wall RW of the display 110. Thus, the rear wall of the rearmost pocket of the center row II' will have one less ply than the adjoining rearmost pockets of rows I' and III'. Notwithstanding this fact, the strength of display 110 is not materially affected.

Secondary blank 112 is similar to secondary blank 12, FIG. 3, except that two sets of slots 164, 165 are formed in panels 156, 158 and 161 and panel 154, respectively. The slots of each set are disposed in spaced parallel relation. The relative spacing between the slots of a set and the setin of each slot from the adjacent side edge of the blank 112 corresponds to that of the slots 120 and 126. When setup, blanks 111 and 112 are assembled relative to one another to form display 110 whereby the slots 120, 126, 164 and 165 will accommodate the corresponding partitions PT' which separate adjoining row, each partition PT' in the illustrated display 119 is of two ply thickness; that is say the plies, comprising panels 135, 138 are folded into face to face relation. If panel 138, which is optional, is eliminated then each partition PT' would consist of only a single panel (ply) 135 and slots 120, 126, 164 and 165 would be narrower. As shown in FIG. 11 panel 116 may be provided with a pair of laterally spaced punch-out key-hold shaped openings K which facilitate having the display wall hung. The openings K are optional.

The rear wall RW of each display 10, 110 has a greater height than the front wall FW so as to compensate for the variations in the elevation of the bottom sections of the pockets in a row. The invention is not intended to be limited thereto because in certain instances it might be desirable to have the bottom sections of all the pockets in a given row at the same level. In the latter situation, the spacing between foldlines 55, 57 and 60 would vary from that shown. Furthermore, the number of rows of pockets and the number of pockets comprising a row may vary from that shown without departing from the scope of the invention.

I claim:

1. A counter display rack formed from complemental primary and secondary blanks of foldable sheet material, said display rack comprising a plurality of open top pockets arranged in at least one row extending from a front wall to a rear wall of the display rack, each pocket having a recessed bottom section and upright multi-ply thickness front, rear and side sections; said primary blank, when setup, defining exterior front, rear, side and bottom walls of the display rack, the setup primary blank also defining the front, rear, side and recessed bottom sections of at least one pocket of the row; the secondary blank, when setup, defining at least the front, rear and recessed bottom sections of a second pocket of the row.

2. The counter display rack of claim 1 wherein at least three pockets comprise a row and the setup secondary blank defines the front, rear and recessed bottom sections of at least the middle pocket of the row.

3. The counter display rack of claim 1 wherein the secondary blank includes a separable segment connected thereto by a line of perforations, the separated segment defining an upright sign board for removably mounting on an exterior wall of said display rack.

4. The counter display rack of claim 1 wherein the primary blank includes a multilateral bottom wall-forming first panel; a pair of outer side wall-forming second panels foldably connected to opposite first peripheral segments of said first panel; an outer rear wall-forming third panel foldably connected to a second peripheral segment of said first panel, said second peripheral segment being intermediate said first peripheral segments; an outer front wall-forming fourth panel foldably connected to a third peripheral segment of said first panel, said third peripheral segment being opposite said second peripheral segment; an inner front wall-forming fifth panel foldably connected to said fourth panel and disposed opposite said first panel; an inner rear wall-forming sixth panel foldably connected to said third panel and disposed opposite said first panel; and intermediate rear wall-forming seventh panels foldably connected to corresponding first peripheral segments of said second panels, said seventh panels being disposed on opposite sides of said third panel and independent thereof, said seventh panels being interposed said third and sixth panels, when said primary blank is setup.

5. The counter display rack of claim 4 wherein the primary blank includes inner side wall-forming eighth panels foldably connected to corresponding third peripheral segments of the second panels; a ninth panel foldably connected to the sixth panel and adapted to define an elevated bottom section of the rearmost pocket when the primary blank is setup.

6. The counter display rack of claim 5 wherein the primary blank includes partition-forming tenth panels foldably connected to corresponding peripheral segments of the seventh panels, said tenth panels being disposed transversely of the seventh panels and substantially spanning the distance between the front and rear walls of the display when the primary blank is setup.

7. The counter display rack of claim 6 wherein each partition-forming tenth panel includes a pair of foldably connected sections which are adapted to assume upright substantially face to face relation when the primary blank is setup.

8. The counter display rack of claim 7 wherein the primary blank includes an eleventh panel foldably connected to the ninth panel, said eleventh and sixth panels being disposed on opposite sides of said ninth panel; said sixth, ninth and eleventh panels being provided with a common elongated slot disposed substantially transverse to a foldline connecting said third and sixth panels, the slot having a width for accommodating a portion of the partition when the primary blank is setup.

9. The counter display rack of claim 1 wherein the secondary blank includes a bottom section-forming first panel; a rear section-forming second panel foldably connected to one peripheral segment of the first panel; a front section-forming third panel foldably connected to a second peripheral segment of the first panel, said second peripheral segment being opposite the one peripheral segment; when the secondary blank is setup, the first, second and third panels thereof coact with the side walls of the display rack to form at least a second pocket disposed forwardly of the rearmost pocket and having a recessed bottom section, the latter being in spaced relation with respect to the bottom wall.

10. The counter display rack of claim 9 wherein the second panel of the setup secondary blank has a first portion thereof disposed in substantially face to face relation with the front section of the rearmost pocket and a foldable second portion overlying the upper edge of the rearmost pocket front section.

11. The counter display rack of claim 10 wherein the secondary blank includes a fourth panel foldably connected to the third panel and disposed opposite the first panel; when said secondary blank is setup, said fourth panel being in substantially face to face relation with said third panel and forming a rear section of a third pocket disposed forwardly of the second pocket, said rearmost, second and third pockets being arranged in a row extending between the front and rear walls of the display rack.

12. The counter display rack of claim 11 wherein the first, second and third panels of the secondary blank are provided with a common elongated closed end first slot extending substantially transversely of the folding connection between the first and second panels, one closed slot end being disposed within the second panel and the second closed slot end being disposed in the third panel, and said fourth panel being provided with an elongated second slot having one end thereof terminating at the periphery of said fourth panel; said first and second slots being disposed in spaced, substantially endwise alignment.

13. A counter display rack formed from complemental primary and secondary blanks of foldable sheet material, said display rack comprising a plurality of open top pockets arranged in at least two rows disposed in side by side relation, each row extending from a front wall to a rear wall of the display rack, adjacent rows being separated from one another by a partition spanning the distance between the front and rear walls of the display rack, each pocket having a recessed bottom section and upright multi-ply thickness front, rear and side sections; the setup primary blank defining said partition and portions of the setup secondary blank straddling and interlockingly engaging said partition and forming the recessed bottom sections of predetermined pockets.

14. A counter display rack formed from complemental primary and secondary blanks of foldable sheet material, said display comprising a plurality of open top pockets arranged in three substantially parallel rows, each row having a like number of pockets and extending from a front wall to a rear wall of the display rack, adjoining rows being separated from one another by elongated upright partitions, each pocket having a bottom section and upright multiply thickness front, rear and side sections; said primary blank, when setup, defining exterior front, rear, side and bottom walls of the display rack, a pair of interior partitions disposed in spaced relation and substantially spanning the distance between the front and rear walls, and the front, rear and bottom sections of at least the rearmost pocket of each row; the secondary blank, when setup, interlockingly engaging the partitions and coacting therewith to define at least the front, rear, and bottom, sections of a pocket disposed forwardly of the rearmost pocket of each row.

15. The counter display rack of claim 14 wherein portions of the setup secondary blank effect separation of predetermined pockets within each row.

* * * * *